United States Patent [19]

Shore

[11] Patent Number: 5,020,591

[45] Date of Patent: Jun. 4, 1991

[54] OIL TOOL COUPLING DEVICE

[76] Inventor: James B. Shore, 110 Royal Ct., Friendswood, Tex. 77546

[21] Appl. No.: 405,318

[22] Filed: Sep. 11, 1989

[51] Int. Cl.[5] ..... E21B 43/16; F16L 37/252

[52] U.S. Cl. ..... 166/55; 175/2; 285/178

[58] Field of Search ..... 285/308, 351, 321, 374, 285/403, DIG. 22, 138, 140, 141, 178, 314, 312, 317, 315, 316; 175/2, 4, 6; 166/55, 55.1

[56] References Cited

U.S. PATENT DOCUMENTS

| | | | |
|---|---|---|---|
| 2,741,316 | 4/1956 | Long | 285/314 X |
| 3,136,366 | 6/1964 | Brown et al. | 285/308 X |
| 3,667,788 | 6/1972 | Greenwood | 285/178 X |
| 3,718,350 | 2/1973 | Klein | 285/321 X |
| 3,915,226 | 10/1975 | Savage | 285/316 X |
| 3,973,791 | 8/1976 | Porta et al. | 285/351 X |
| 4,278,276 | 7/1981 | Ekman | 285/321 X |
| 4,603,886 | 8/1986 | Pallini, Jr. et al. | 285/308 X |
| 4,771,832 | 9/1988 | Bridges | 285/178 X |

*Primary Examiner*—Stephen J. Novosad

[57] ABSTRACT

A locking device for a pin and socket interconnection of tubular well tool housings where a locking mechanism has a first rotatably mounted annular locking member on a second locking member on a pin end. The locking members have cooperating cam surfaces and locking segments which can be moved from a non-engaged position to our engaged position within a locking groove in a socket member. The locking members are actuated by relative rotation and also have a guide slot system for contemporaniously driving the pin end and socket member longitudinally relative to one another to a position compresssing O-rings between the pin end and socket member and a locked position of the pin end and socket member.

25 Claims, 6 Drawing Sheets

OIL TOOL COUPLING DEVICE

FIELD OF THE INVENTION

This invention relates to quick connect couplings, for interconnecting pin and socket members, and more particularly, to quick connect couplings for use with oil field tools having pin and socket members and O-ring sealing means.

BACKGROUND OF THE INVENTION

In oil field operation of equipment it is necessary from time to time to couple lengths of tubular housings to one another from a location on the floor of the drilling rig. The housings are typically threadedly interconnected to one another while in a vertical aligned relationship to form an elongated housing of the desired length for transportation into a well bore traversing the earth formations. Typically in a well which traverses the earth's formation and is filled with drilling or other type of control fluid, the hydrostatic pressures and temperatures downhole are significantly greater than ambient temperatures and pressures. As a consequence, it is both necessary and desirable to use sealing elements in the interconnection between housings to prevent the intrusion of fluids under well bore pressure to the interior of the well tool.

Because operational time of a drilling operation is very expensive, the time required to threadedly couple or make-up tubular housing members to one another for a well bore operation can be an expensive cost factor. In addition, the types of coupling threads employed on housings are expensive to cut and some care must be taken in assembly to avoid improper threading or galling of the threads during make up. This is particularly true with oil well perforating devices where the length of the tools can require a number of housings to be threadedly interconnected.

THE PRESENT INVENTION

The present invention involves a quick connect coupling device where a cylindrically shaped pin member carrying O-ring seals is insertable into an open end of a tubing or socket housing member. On the pin member is a rotatable tubular locking member which is rotated manually by an external removable lever means. The pin member with a locking member is inserted into the open end of the socket housing member. The locking member has circumferentially arranged, oppositely disposed arcuately shaped, locking segments which are normally in a retracted condition in a cylindrical recess on the pin member. When the locking member is externally and manually rotated relative to the pin member by the lever means, the locking segments on the locking member are cammed or urged radially and progressively outwardly radially relative to a cylindrical surface of the pin member and brought into engagement with an annular locking groove located in the open end of the socket housing member. Additionally, the locking member, following interengagement of the locking segments with the locking groove relative to the pin member, is moved longitudinally with continued rotation and carries the interengaged socket housing member over "O" ring seals on the pin member and into an abutting relationship with the locking member. The pin member and the socket member are locked or coupled to one another with as little as 90° relative rotation of the locking member.

The locking member is formed from symmetrically configured semi-cylindrical parts which are bolted to one another to form a tubular locking member. The parts can be investment cast molded steel which eliminates machining operations. Each semi-cylindrical part of the locking member has locking segments which are attached by connecting flexible strips to a ring segment where the connecting strips are canted inwardly toward a central longitudinal axis to bias the locking segments inwardly toward the central axis. The ring segment has an inwardly extending guide lug member.

In a preferred mode, the pin end member has an annular recess which can be machine turned. Longitudinally spaced from the annular recess are annular O-ring sealing grooves for receiving resilient O-rings.

A base member is formed from symmetrically configured semi-cylindrical parts which are bolted to one another to form a tubular base member which can be rotatably mounted in the annular recess on the pin end member. A base member part has a circumferentially extending guide lug slot which has first and second circumferential portions longitudinally offset from one another and connected by an inclined circumferential portion. The first and second slot portions lie on planes transverse to a longitudinal axis of the pin end member.

The guide lug member on a ring segment of the locking member is slidably received in the guide lug slot of the base member on a pin end member and is shiftable in a longitudinal direction between the first and second slot portions and thus relative rotation between the locking member and the base member causes longitudinal movement of a ring segment and the locking member on a base member.

Longitudinally displaced from the guide lug slot on the base member is a circumferentially extending outer wall surface face which is less than 180° and which has first and second wall portions which are radially offset from one another and which are connected by a circumferentially inclined portion. There are two such wall surfaces which are symmetrical with respect to one another and located on diametrical positions. Only one wall surface will be explained.

The first and second wall portions of a wall surface have different radii relative to the longitudinal axis of the pin member. At the smaller radii portion, the locking segments of a ring member are inwardly retracted and the guide lug member on the locking member is in a first slot portion in the base member. In this position, the socket housing member is receivable over the pin end member so that the annular locking groove is adjacent to a locking segment on a locking member. A first O-ring can be compressed between the pin end member and the socket member in this position.

By holding the base member in a fixed position, the locking member can be rotated by a lever means relative to the base member. Upon rotation, a locking segment first engages the circumferentially inclined portion on the base member and moves radially outward into interengagement with the locking groove in the socket member. The locking segment next continues to be moved radially outward while the guide lug member engages the inclined slot portion and then moves the end of the socket member toward the base of the locking ring. The guide lug member next enters the other slot portion where the end of the socket member abuts or is closely adjacent to the locking ring. Both of the O-rings are fully compressed during the longitudinal travel of the socket housing.

DESCRIPTION OF THE DRAWINGS

FIG. 25 is a side view of a modified locking element.

DESCRIPTION OF THE PRESENT INVENTION

Figure 1:
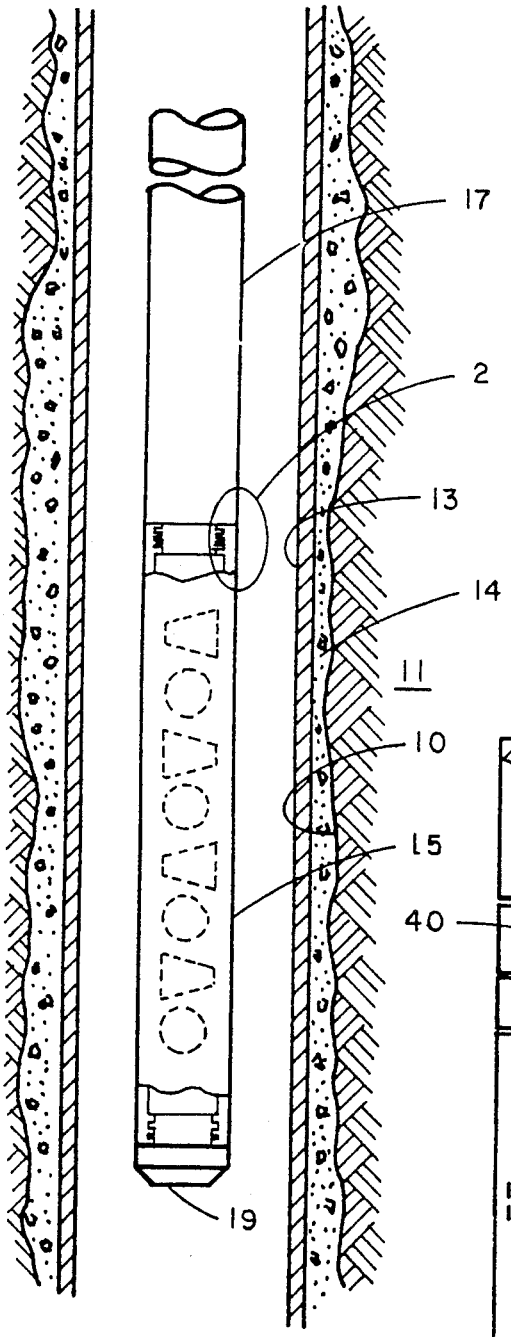
FIG. 1 is a schematic view in longitudinal cross section through a we bore containing a well perforating gun.

Referring now to FIG. 1, a well bore 10 traverses earth's formations 11 and extends downwardly from a ground surface, not shown. The well bore 10 is lined with a string of pipe 13 which is cemented in place by a column of cement 14. A first perforating apparatus or gun 15 is illustrated as attached to one or more perforating apparatuses 17. A tubing string (not shown) is used to lower the gun assembly to the desired level in the well bore relative to the earth formations. Gun strings up to one thousand feet in length have been lowered on a tubing string for perforation operations. Shaped charges or perforating means in the gun can be operated to produce penetrations or openings through the well casing, the column of cement and extent into the earth formations for the production of hydrocarbons into the bore of the pipe 13. The perforating apparatus is typically a tubular housing member which consists of one or more threadedly interconnected lengths of tubular gun sections. The well bore is filled with fluid creating a hydrostatic pressure and is at a temperature normalized to the surrounding area. If desired, the gun could also be lowered on a wireline.

Figure 2:
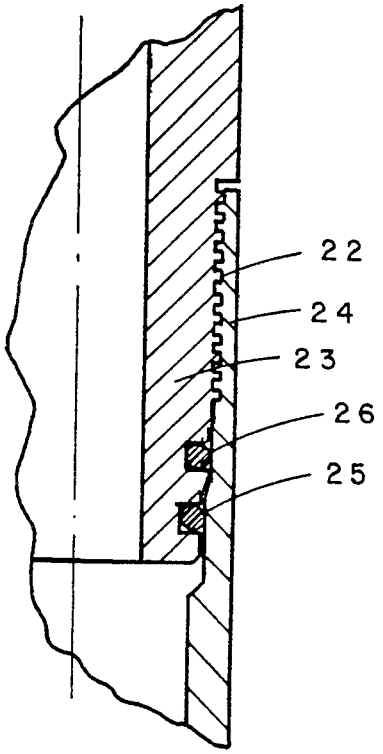
PRIOR ART FIG. 2
FIG. 2 is a partial view in cross section through a prior art threaded connection.

The lower end of the perforator apparatus typically has a threadedly attached nose plug 19. The threaded interconnections, as shown in enlarged FIG. 2, include high grade cut threads 22 on a pin member 23 and on a socket member 24. As shown in FIG. 2 a first O-ring seal 25 is disposed in a section of the socket member 24 which has a smaller diameter than the diameter of the socket member 24 containing a second O-ring seal 26. The purpose for dual O-rings is to prevent leakage under high temperature and pressure. The O-rings 25,26 are under considerable compression. A threaded interconnection, however, generates sufficient coupling force to move the pin and socket members longitudinally relative to another in making up the parts to compress the O-rings and insure a tight O-ring compressive seal. It can be noted, however, that in making up the threaded parts it is necessary at the surface of the rig to hold one of the parts, for example, the socket part in the casing tongs, while the upper part is rotated through a drive kelly or the like through a number of revolutions. It takes time to make up the threads at the rig surface, the threads are expensive to cut or machine in the parts with the proper tolerances and there is always a possibility of misthreading which further delays the operation all because of the threaded interconnection of the two parts.

In the present invention, the structure comprising the movable operative locking elements of the device are constructed from investment cast steel and require little or no machining. In addition, the coupling of a pin and socket members to one another is obtained by a relatively easy partial rotation of a locking member in the locking device without requiring rotation of a housing.

Figure 3:
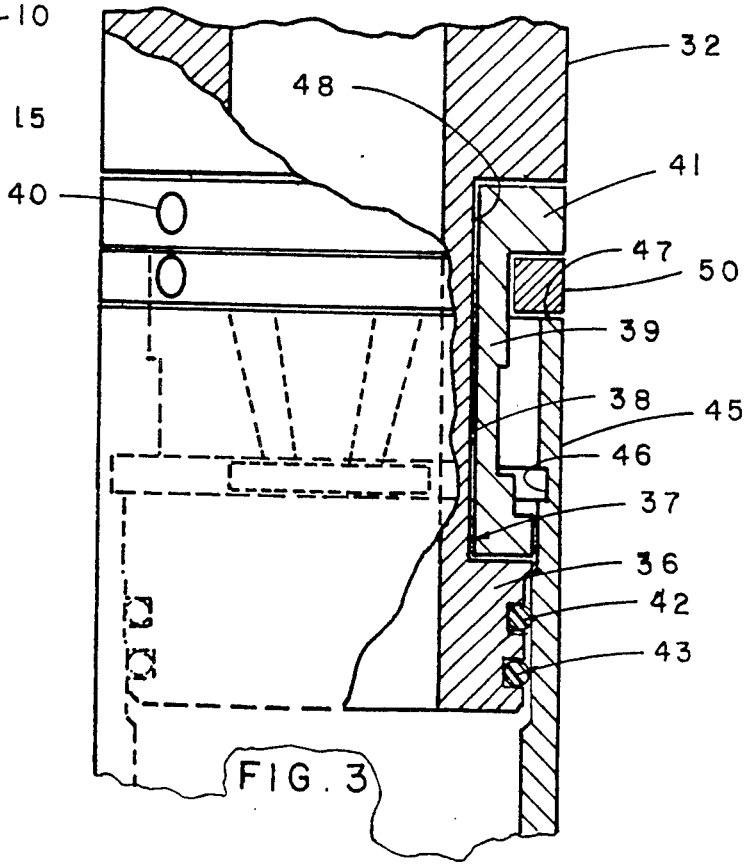
FIG. 3 is a view in partial cross section of the coupling of the present invention.

As shown in FIG. 3, one of the housing members 32 has a pin end 36 (which can be tubular) where the pin end has an annular recess 37. The recess 37 can be easily formed by a turning operation on a lathe. The annular recess 37 has a first cylindrical recess surface 38 for rotatably supporting an annular, first or inner locking member 39 of a locking mechanism. A radially extending pin opening 40 in a flange 41 of the first locking member 39 permits insertion of a rod or lever to manually hold or to manually rotate the first locking member 39 about the longitudinal axis of the housing member 32.

At the terminal end of the pin end 36 are first and second O-ring grooves 42,43 which are respectively located in cylindrical sections having different diameters. The housing socket member has a tubular socket end 45 with longitudinally spaced bore sections having different diameters for sealingly receiving the O-rings 42,43. The socket end 45 has an annular locking groove 46 between the O-rings and the terminal end 47 of the socket end 45.

The first locking member 39 is comprised of two identically formed semi-cylindrically shaped elements or parts which bolt to one another to form an annular locking member which is rotatably mounted in the recess 37 in the pin end 36. Cross sections through one of the semi-cylindrical elements are shown in FIGS. 6-10. The first locking member 39 has an outer recessed and cylindrical section 48 which rotatably receives an annular second locking member 50.

Figure 11:
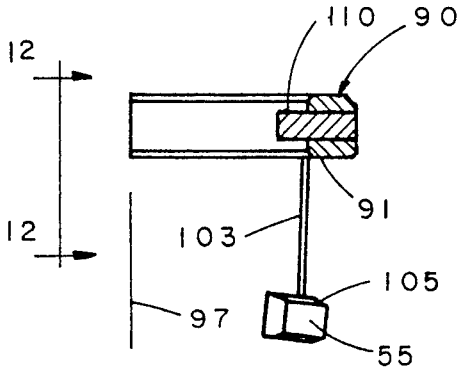
FIG. 11 is a partial view in cross section vertical plane along line 11—11 of FIG. 12.
Figure 12:
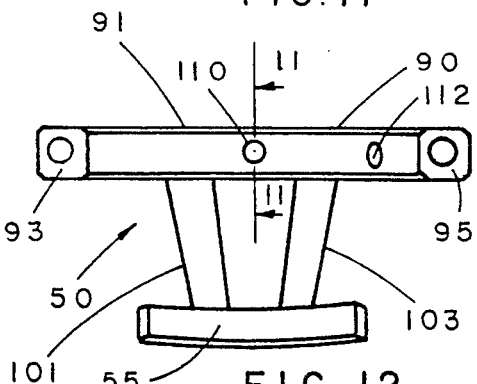
FIG. 12 is a view taken along line 12—12 of FIG. 11.
Figure 13:
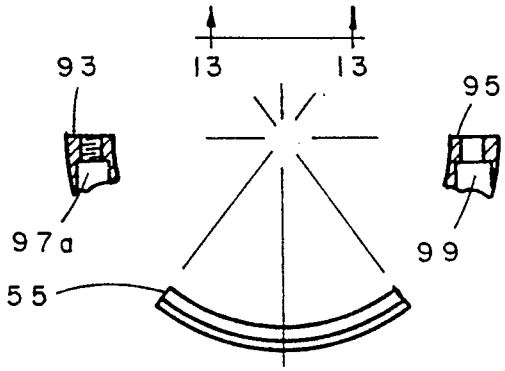
FIG. 13 is a partial view taken along line 13—13 of FIG. 12.
Figure 10:
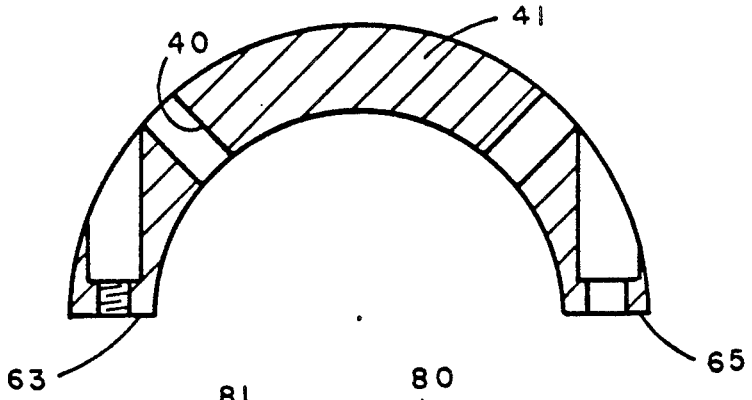
FIG. 10 is a partial view of a base member taken along line 10—10 of FIG. 4.
Figure 9:
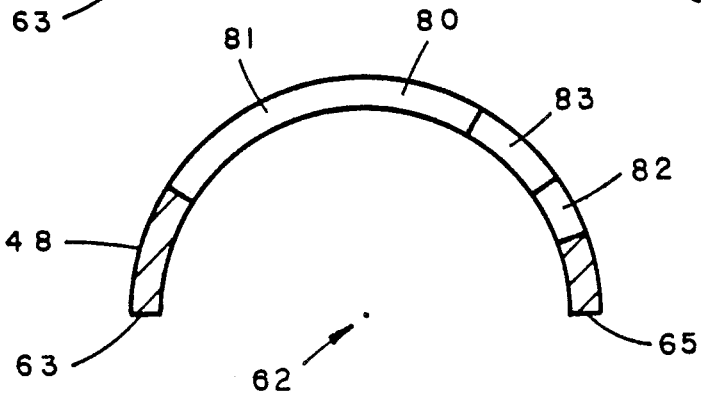
FIG. 9 is a partial view of a base member taken along line 9—9 of FIG. 4.
Figure 8:
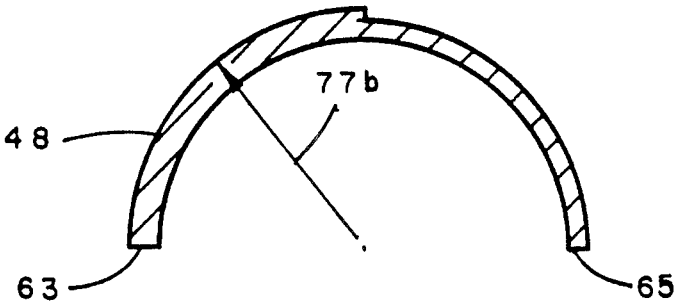
FIG. 8 is a partial view of a base member taken along line 8—8 of FIG. 4.

The second locking member 50 is rotatively mounted on a cylindrical surface of the recessed cylindrical section 48. The second locking member 50 is comprised of two identically formed semi-cylindrically shaped elements or parts which bolt to one another to form an annular second locking member 50 rotatively mounted on the first locking member 39. One of the semi-cylindrical base elements of a second locking member is shown in FIGS. 11–13.

Referring still to FIG. 3, the locking mechanism is shown in a locked or coupled condition where the end 47 of a socket member 45 abuts or is closely adjacent to a flange surface on the second locking member 50. The second locking member 50 is rotatively mounted on the cylindrical section 48 in the first locking member 39. The first locking member 39 is rotatively mounted in the recess 38 on the pin end 36. When the second locking member 50 is in an unlocked condition and is then rotated about the longitudinal axis of the pin end 36 relative to the first locking member 39, the locking member 50 is moved longitudinally relative to the first locking member 39 and semi-cylindrical locking or latching elements 55 on the second locking member 50 are moved from a non-engagement position into locking engagement position within the annular locking groove 46 in the socket member 45. The second locking member 50 and the socket member 45 are also moved longitudinally to the coupled position shown in FIG. 3.

Figure 5:
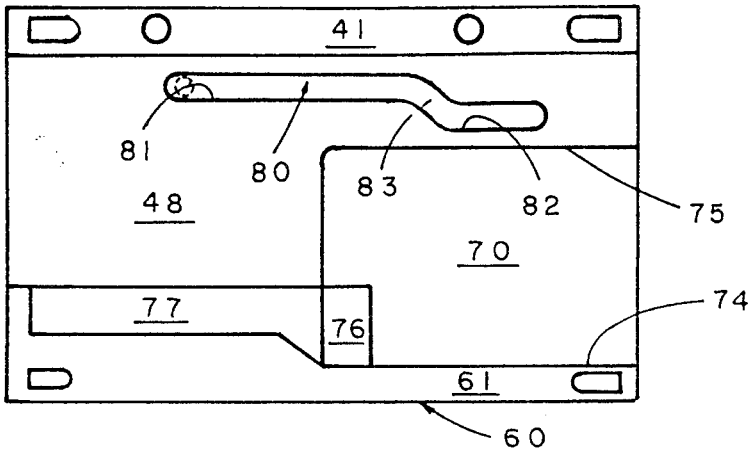
FIG. 5 is a 180° view of a base member in the plane of the drawing.
Figure 4:
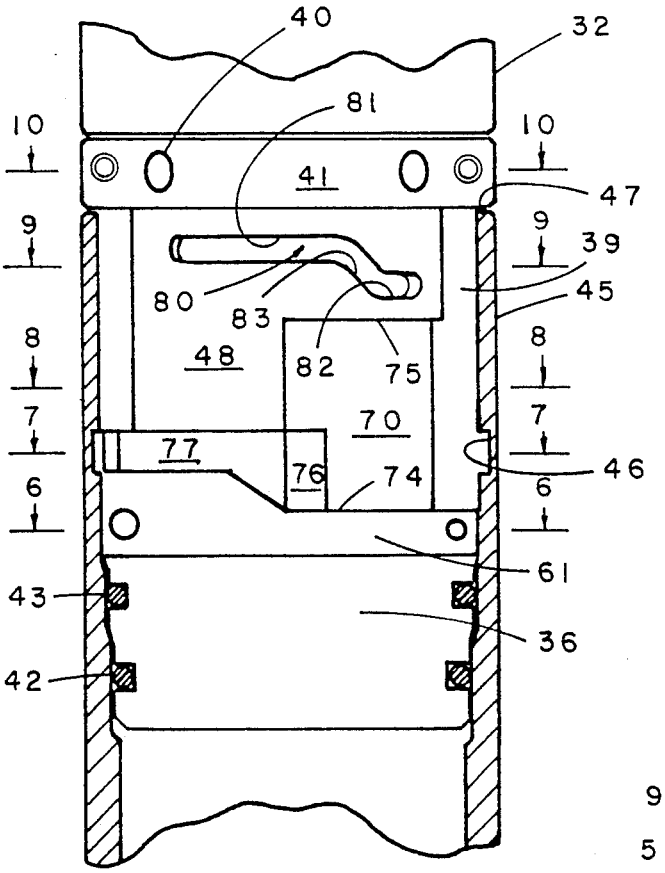
FIG. 4 is a view in partial cross section showing the base member on a pin end member.

Referring now to FIGS. 4–10, for specific details of the configuration of the present invention, the two semi-cylindrical segment parts of the first locking member 39 are identical so that illustration and discussion of one segment part 60 is sufficient for understanding the principles of construction and operation of the first locking member 39. FIG. 4 is similar to FIG. 3 but does not show the second locking member 50 and shows a view of the outer surface of the first locking member where the socket member 45 is shown in longitudinal cross section. FIG. 5 is a 180° folded out or developed view of the outer surface of the one segment part 60.

Figure 6:
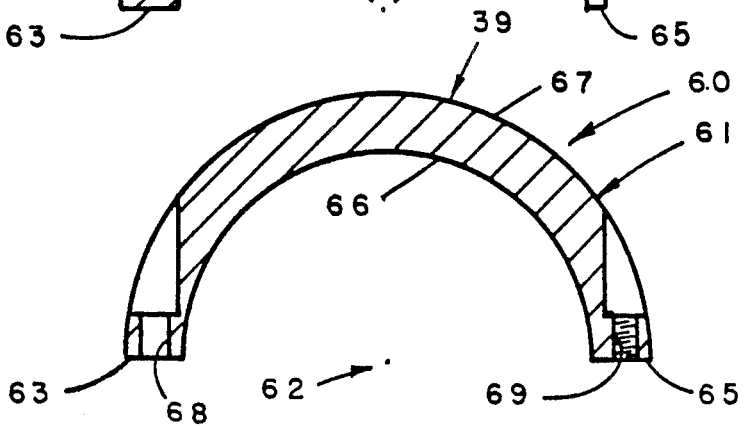
FIG. 6 is a partial view of a base member taken along line 6—6 of FIG. 4.

A segment part 60 of the first locking member 39 has a semi-cylindrically shaped flange portion 61 disposed in a plane which is transverse to a longitudinal axis 62 for a segment part 60 (FIG. 4, FIG. 6). The flange portion 61 terminates with flat abutment surfaces 63,65 (FIG. 6) which lie in a longitudinally extending plane which intersects the longitudinal axis 62 for the locking member 39. The section of the segment part 60 illustrated in FIG. 6 shows the flange portion 61 which has inner and outer cylindrically shaped walls 66,67 where the curvature of the walls is uniform about the longitudinal axis 62. A counterbored bolt opening 68 and a counterbored threaded bolt opening 69 are disposed along axes which are perpendicular to the plane of the surfaces 63,65. By abutting two parts 60 to one another, cap screws are used to attach the parts to one another.

Figure 7:
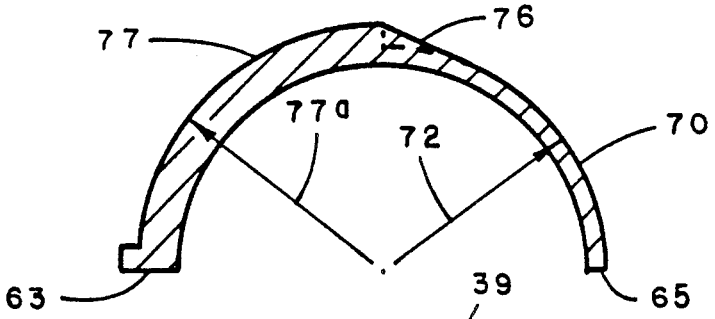
FIG. 7 is a partial view of a base member taken along line 7—7 of FIG. 4.

Longitudinally disposed and adjacent to the flange portion 61 is a first cylindrically shaped outer wall surface 70 with a given radius 72 where the outer wall surface 70 is located between longitudinally, spaced apart and facing shoulder surfaces 74,75. (See FIG. 4, FIG. 5). The outer wall surface 70 extends angularly about the longitudinal axis of the part 60 from one abutment surface 65 for about 90°. Circumferentially adjacent to the outer wall surface 70 for the remaining 90° extending to the other abutment surface 63 is another outer wall surface 77 which has a larger given radius **77*a* than the radius 72. The two wall surfaces 70, 77 are merged or connected to one another by an angular circumferential section of inclined wall surface 76. (FIG. 5, FIG. 7). The outer wall surface 70 provides a recess for locating the locking segments 55 on a locking element 50 in a retracted condition while the outer wall surface 77 can engage and hold locking segment 55 in a locking condition in a locking groove 46 in a socket member 45. The inclined surface 76 radially guides and moves a locking segment 55 progressively from a retracted condition on one surface 70 to an extended condition on the other surface 77**.

The surface 48 adjoins the surface 77 and has a lesser radius **77*b* than the radius 77*a*. As shown in FIGS. 4 and 5, the transverse edge surface 75 separates the outer cylindrical surface 48 from the cylindrical surface 70. The cylindrial surface 48 extends uniformly about the longitudinal axis 62. A lug guide slot 80 extends circumferentially about each part at an angle of less than 180°. The guide slot 80 has a first slot portion 81 located in alignment with a longitudinal plane which is transverse to the axis 62. The guide slot 80 has a second slot portion 82 located in aligment with a longitudinal plaenw hich is transverse to the axis 62. The slot portion 81 is longitudinally offset from the slot portion 82 with the slot portions 81,82 being interconnected by an inclined slot portion 83. The angular relationship of the lug guide slot 80 is related to the angular position of the surfaces 70 and 77 so as to progressively actuate the locking elements 55 as will be explained hereafter. Located next to the surface 48 is a flange 41**.

Referring to FIGS. 11–13, one of the second locking parts 90 of a locking element 50 is illustrated. The locking part 90 has a semi-cylindrical ring portion 91 which is sized to be rotatively received on the cylindrical bearing wall surface 48 of the first locking member. The ring portion 91 has abutment surfaces 93,95 disposed in a longitudinally extending plane which lies on the longitudinal axis 97 for the part. The longitudinal axis 97 coincides with the longitudinal axis 62. The ring portion 91 has one threaded and counterbored opening 97 and one counterbored bolt opening 99 located at 180° from one another for attachment of the parts to one another. (FIG. 13) Thus, when two half parts are brought into abutment, bolts fit through bolt openings and threadedly couple the half members to one another.

Extending longitudinally relative to the ring portion 91 are a pair of circumferential spaced apart, strip members 101,103. (FIG. 11, FIG. 12) The strip members 101,103 are rectangular in cross section and attach to a semi-circular arcuate locking element 55. The locking element 55 is generally rectangular in cross section and is attached to the strip members 101,103 so that there is an outwardly projecting arcuate segment 105 relative to the strip members 101, 103. The segment 105 is thus available for latching in a locking groove. As illustrated, the strip members 101,103 are canted, inwardly slightly toward the center axis 97 of a second locking member. A guide lug 110 is mounted in a transverse opening in the ring portion 91 and extends radially inwardly toward the longitudinal axis 97. The guide lug 110 is adapted to be slidably received in the lug slot system 80. An opening 112 in the ring portion 91 permits use of an external rod or lever (not shown) to rotate the locking parts.

The locking parts 90 are attached to one another and rotatively mounted on the outer bearing surface 48 of the first locking member. In a retracted (unlocking) condition of the locking elements 55, the locking elements 55 are biased by the position of the strip members 101,103 to an inward location resting upon the outer wall surface 70 while the guide lug 110 is in the slot portion 82.

While the lug member 110 in the second locking member is located in the short slot portion 82 of the transverse lug slot system 80, the ring portion 91 of the second locking member is spaced longitudinally away from the flange member 41 on the first locking member because of the location of the lug 110 in a slot portion 82. In this position, the locking elements 55 rest on the surface 70 in a retracted condition. The locking elements 55 do not engage the annular groove 46 at this time.

When the second locking member 50 is rotated relative to the first locking member 39, the lug 110 in the short slot portion 82 of the first locking member travels to the inclined slot portion 83 and one end of a locking element 55 travels midway along the inclined surface 76 which progressively urges the arcuate segment 105 of a locking element 55 into the locking groove 46 of a socket housing. At this time, the O-rings in the grooves 43,42 are positioned to be compressed by the compression surfaces in the socket housing 45, and, if desired, one of the O-rings can be within a compression surface. As any experienced person realizes, considerable longitudinal force is required to seat both O-rings within the socket housing 45.

The lug 110 next engages in the inclined slot portion 83 which moves the locking element 55 longitudinally of the inclined member 76 while continuing to urge the locking element 55 outwardly into the locking groove 46. At the same time, the engagement of the locking element 55 in the locking groove 46 moves the socket member 45 in a longitudinal direction and compresses the O-rings. When the lug 110 enters into the long slot portion 81, the locking elements 55 are fully extended into the locking groove 46 and supported by the underlying wall surfaces 77. The end surface 47 of the socket housing abuts the end surface of the flange 91. The coupling is made with only a 90° turn of a locking element.

Both the locking member 39 and 50 can be made by investment casting of steel so that no expensive machining is required. The connector is simply constructed and operated.

While the preferred form of the present invention contemplated separate locking members 39 and 50, the inner locking member 39 can be an integral part of a pin end if so desired and need not be a separate component.

Figure 14:
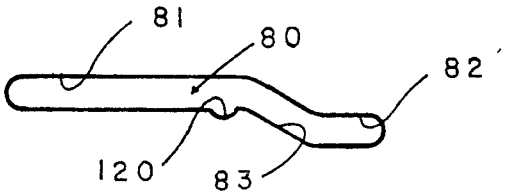
FIG. 14 is a view illustrating a modification to the guide slot.
Figure 15:
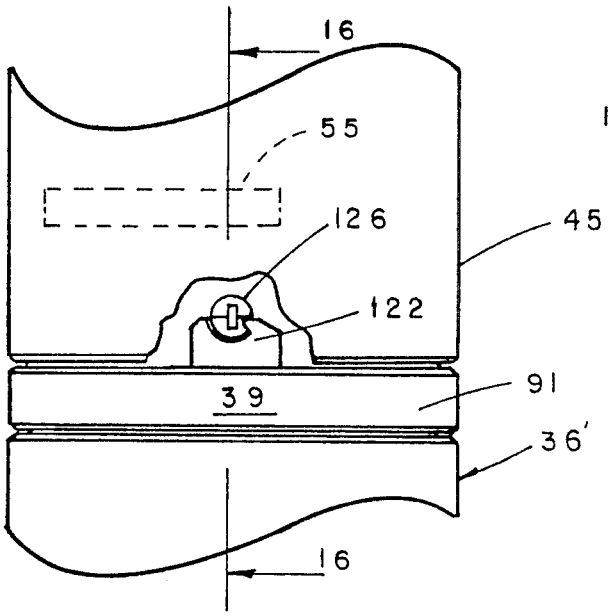
FIG. 15 is a side view of a modified tool with an optional locking device.

Referring now to FIG. 14, the lug slot system 80 can include a pressure recess 120 along the first slot portion 81. The recess 120 is located angularly relative to the guide lug 110 and the arcuate locking element 55 so that the lug 110 is adjacent to the recess 120 before the locking element 55 releases from the annular locking groove 46. If, for any reason the well tool has a high pressure internally relative to the pressure external to the tool then the pin and socket members will tend to separate and the guide lug 110 will be forced into the recess 120. When this happens, the disconnect function will be impeded sufficiently that the operator will be forewarned that the tool contains a high pressure and can exercise care in the disconnect operation.

Figure 16:
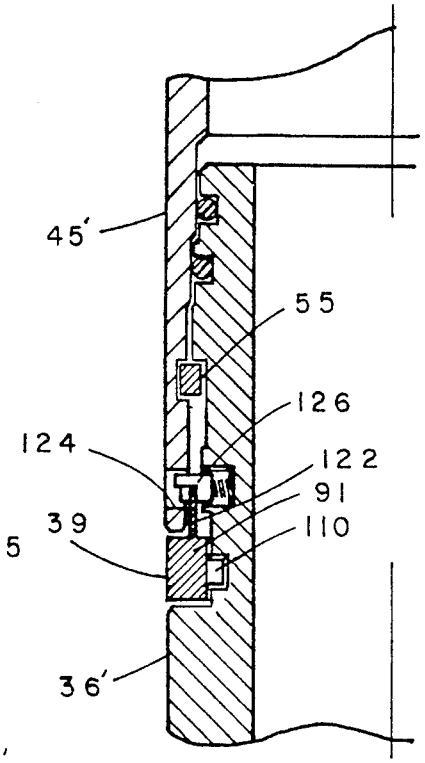
FIG. 16 is a view taken along line 16—16 of FIG. 15.
Figure 19:
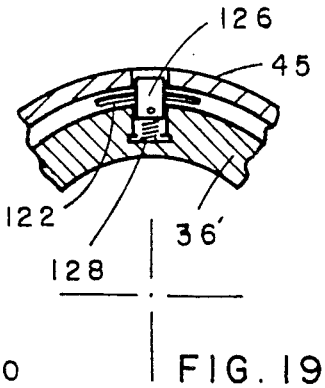
FIG. 19 is a schematic top view of the optional locking device.
Figure 17:
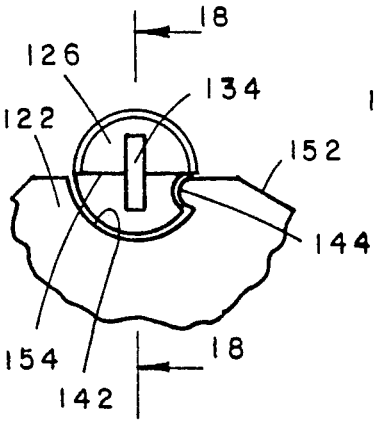
FIG. 17 is a plan view of the optional locking device.
Figure 18:
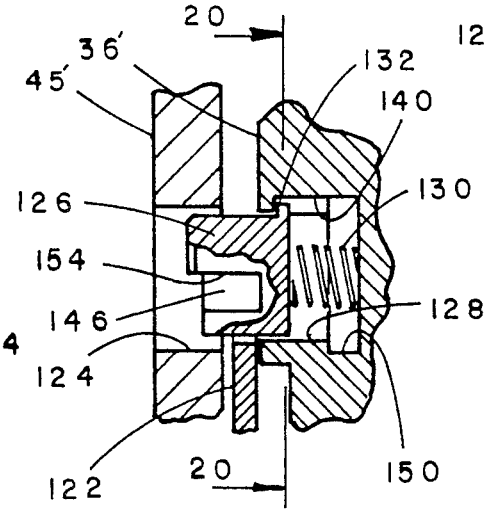
FIG. 18 is a view taken along line 18—18 of FIG. 17.
Figure 20:
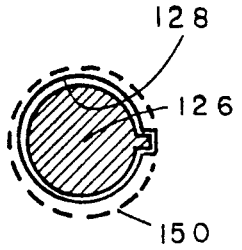
FIG. 20 is a view taken along line 20—20 of FIG. 18.

Referring now to FIG. 15–20 a modification is illustrated where an optional lock is provided to automatically lock the coupling and will require manual interruption to release the coupling. In FIG. 16, the pin end 36' is modified, as described above to incorporate the structure of the second locking member 50 on the pin end 36'. Like parts and functions bear similar member designations. The first locking member 39 is rotatively supported on the pin end 36' and has an arcuate locking plate 122 attached to a ring portion 91 and disposed in the annular space between the pin end 36' and the socket end 45'. The socket end 45' is identical to the socket end 45 except for a cylindrical opening 124 to align with a locking pin 126 when the coupling is in a locking condition. The locking pin 126 is slidably received in a cylindrical recess 128 in the pin end 36' and biased radially outwardly by a biasing spring 130. The pin 126 has a key element 132 on a rearward face which aligns with a screw driver slot 134 in a forward face. In the extended and locked position shown in FIG. 18, the key element 132 is aligned in a transverse key slot 140 and extends into the opening 124 in the socket 45'. In this position, the locking plate 122 has a semicircular recess 142 with a protuberence 144 at one side. The protuberence 144 is aligned with a notch 146 in the locking pin 126 and prevents relative rotation between the pin end and the socket end. To unlock and release the socket end from the pin end, a screwdriver is inserted into the pin 126 to depress the spring 130 and locate the key element 132 in an annular release groove 150. When rotated, the key element 132 is locked in the groove 150 permitting the locking plate to be rotated with the locking ring 91 to an unlocking condition.

The locking ring 126 is actuated when the locking ring 91 is rotated to the locking position by the depressed shoulder 152 engaging a diametrically arranged face 154 on the locking pin so that the locking pin 126 is rotated to a locking position by engagement of the locking plate 122 and the locking pin 126.

Figure 21:
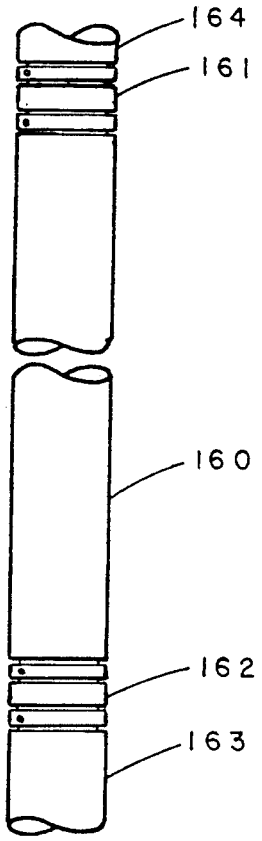
FIG. 21 is a longitudinal view of a typical gun housing and coupling arrangement.
Figure 22:
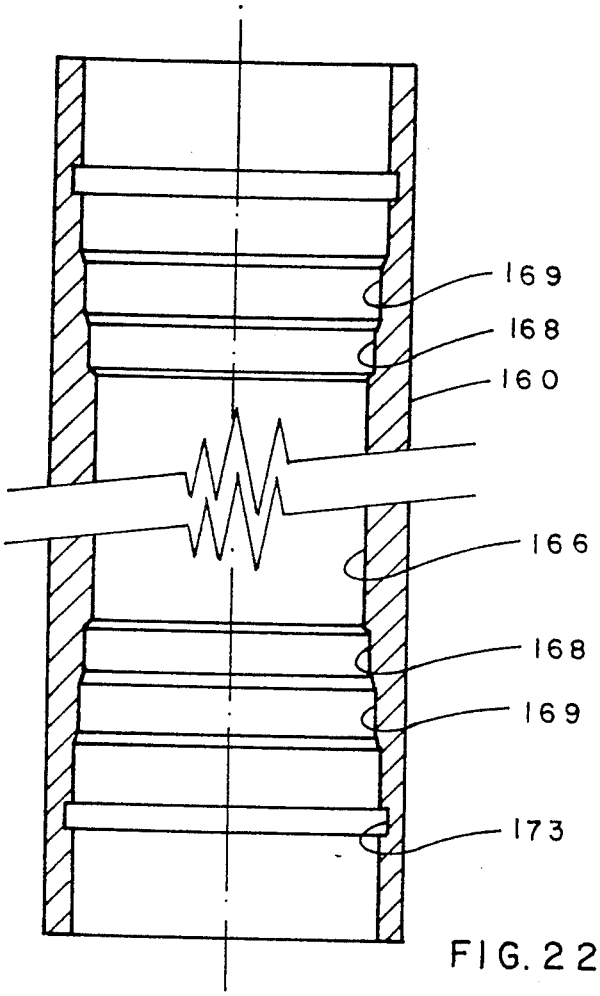
FIG. 22 is a view in longitudinal cross section through a gun housing.
Figure 23:
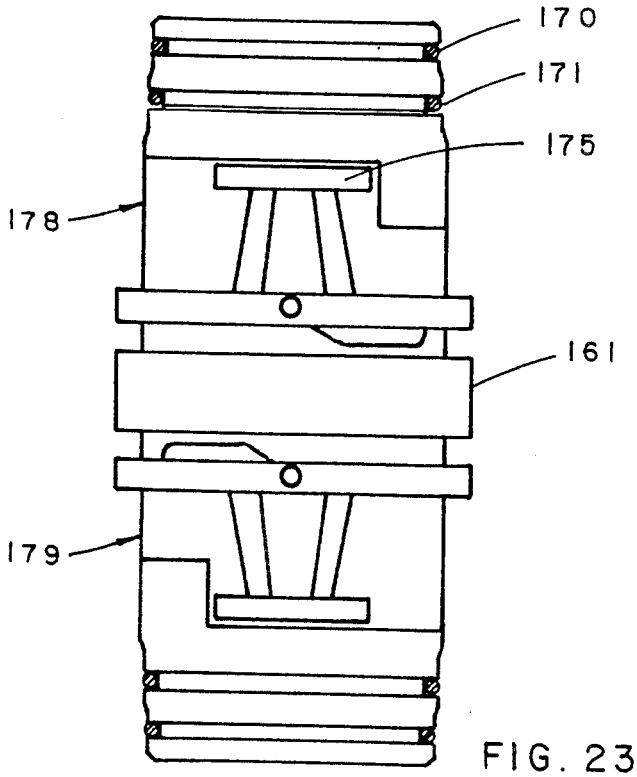
FIG. 23 is an outside view of a coupling member.

Referring now to FIGS. 21–23, tubular gun housings 160, 163, 164 are interconnected to tubular coupling joints 161, 162. As shown in FIG. 22, a typical housing 160 is provided with a central bore 166. At each end of the bore 166 are stepped annular sealing surfaces 168, 169 for receiving the O-rings 170, 171 on a coupling joint 161. Between the stepped sealing surfaces and the end of the joint is the annular locking groove 173 for receiving the locking element 175 on a coupling joint. As shown in FIG. 23, the coupling joint 161 has back to back pin ends 178, 179 each provided with O-rings and the locking elements as previously described.

Figure 25:
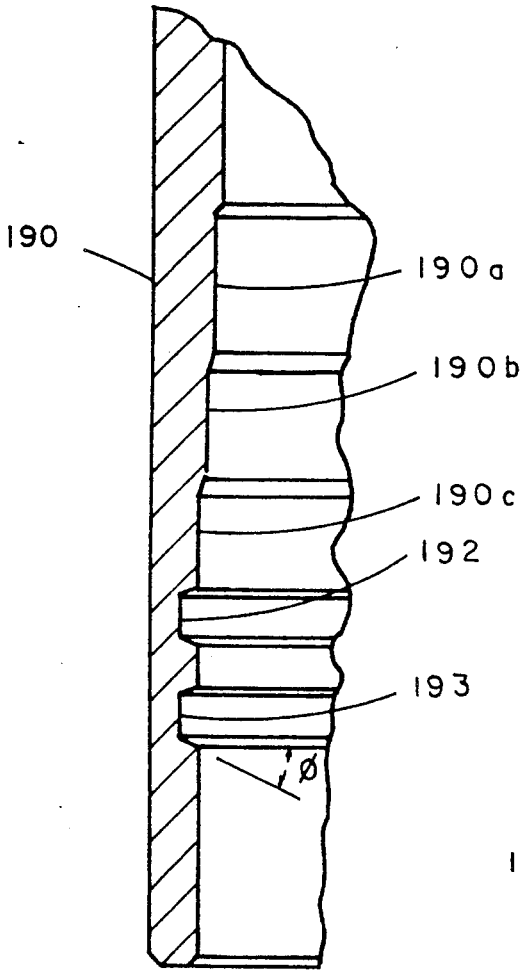
FIG. 25 is a partial longitudinal view in cross section of another embodiment of the invention.
Figure 24:
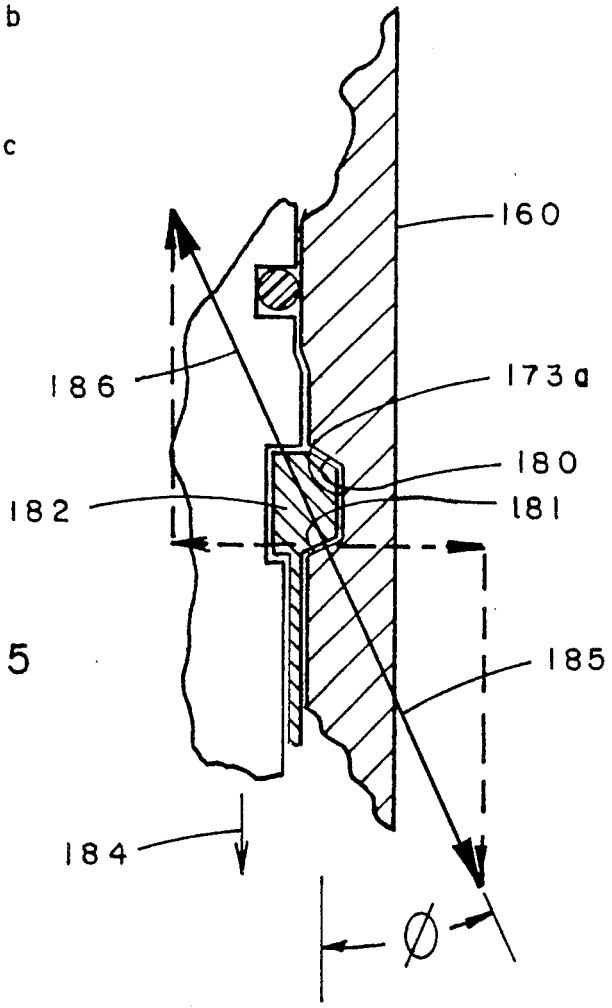
FIG. 24 is a schematic view of another aspect of the present invention in longitudinal cross section through a lug and housing groove.
Figure 26:
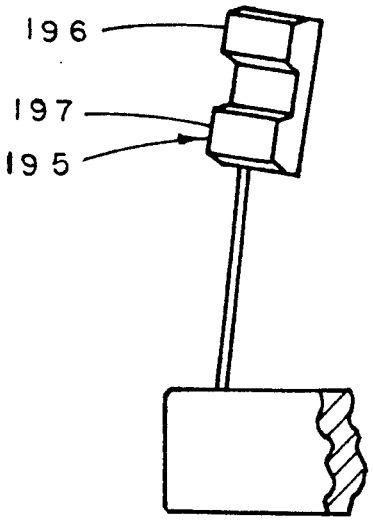

Referring now to FIGS. 24–26, the shock effect of a perforating gun detonation produces an internal pressure in a gun housing which acts on the coupling members and, in particular, places a shear load on the portion of a locking element in a locking groove. If the annular locking groove **173*a* in a housing 160 is provided with upper and lower tapered or inclined surfaces 180,181 in which correspondingly tapered surfaces on a locking element 182 are disposed, then upon detonation of a perforator gun a force is produced on the coupling joint (see Arrow 184) and there is a load on the gun housing 160 as indicated by the arrow 185 and a load on the locking element 182 as indicated by the arrow 186. The loads are normal to the surface 181 and thus reduce the shear load on a locking element while increasing the expansion force on the gun housing. Since the gun housing is expendable this is no problem. The angle of the taper is 15°. The angle of the taper surfaces 180, 181 can be increased or changed as a function of the wall thickness, material and force. In any event, the angle of the interengaging surfaces in an annular groove improves the coupling strength for the locking element by reducing the shear effect on the locking element 182**.

As shown in FIGs. 25 and 26, a housing 190 can have three stepped cylindrical surfaces 190*a*, 190*b*, 190*c* for three O-rings and two annular groves 192, 193 where each groove 192,193 has tapered side wall surfaces ad described with respect to FIG. 24. A locking element 195 then includes spaced apart locking segments 196,197 which respectively interfit with the locking grooves 192, 193. As explained with respect to FIG. 24, the tapered surfaces on the locking segment, 196,197 and in the grooves 192,193 reduce the shear loading effect on the locking segments.

As a matter of economics, the gun housings are uniquely simple in configuration and considerably less expensive to manufacture than housings with threaded ends. In use, the connections are made more efficiently than threaded couplings. The coupling joints are re-usable and provide a quick connect feature.

In operation, one end of the gun housing can be initially coupled to one end of a coupling joint in the shop. On the rig or drill site, the operator need only stab the pin end of a coupling joint into a housing socket end of a gun housing and rotate the locking elements in the coupling joint to compress the O-rings and lock the housing socket end to the coupling joint.

It will be apparent to those skilled in the art that various changes may be made in the invention without departing from the spirit and scope thereof and therefore the invention is not limited by that which is enclosed in the drawings and specifications but only as indicated in the appended claims.

I claim:

1. A locking and coupling device for interconnecting a tubular socket end member having an annular internal locking groove to a cylindrically shaped pin end member receivable in said socket end member, said device including:

an annular locking ring rotatably mounted on said cylindrically shaped pin end member in an annular recess in said pin end member, means for limiting the rotational movement of said locking ring between- first and second angular positions relative to the central axis of said cylindrically shaped pin end member, means coupling said locking ring to said pin end member for moving said locking ring longitudinally relative to said pin end member during rotation of said locking ring member between said first and second angular positions relative to said cylindrically shaped member, at least one arcuate locking element on said locking ring for engaging said internal locking groove and for moving radially and progressively from a nonengagement position into a fully engaged position in said locking groove during rotational movement of said locking ring relative to said pin end member, and cam means on said pin end member for progressively moving said locking element radially into said locking groove.

2. The device as set forth in claim 1 wherein said locking ring is comprised of two mirror image parts, and means for attaching said parts to one another.

3. The device as set forth in claim 2 wherein said locking ring parts are constructed from cast steel.

4. The device as set forth in claim 1 wherein said locking ring includes an annular ring member and an elongated transverse coupling element coupled to said locking element where said coupling element cants said locking element inwardly toward the center axis for said locking ring.

5. The device as set forth in claim 1 wherein O-ring members are disposed and located between said pin end member and socket end member so as to be compressed while said locking ring moves longitudinally relative to said pin end member.

6. The device as set forth in claim 1 wherein said means for moving includes a guide slot and guide lug member.

7. The device as set forth in claim 6 wherein said guide slot includes a pressure recess located angularly relative to said locking element so that said guide lug member is adjacent to said pressure recess prior to release of said locking element from said locking groove.

8. The device as set forth in claim 1 and further including releasable locking means cooperable in one of said angular locations for releasably locking said pin end members and said socket end member in a locked rotative position.

9. The device as set forth in claim 8 when said locking means includes a spring biased detent member and an opening respectively in the pin end member and the socket member.

10. The device as set forth in claim 1 wherein said internal locking groove has at least one end surface which interengages with another end surface on a locking element where said end surfaces are inclined with respect to a plane normal to the central axis of said end member at an angle of 15° or more for minimizing the shear loading on a locking element when disposed in the locking groove.

11. A locking and coupling device for interconnecting well tool housings respectively having tubular socket end member having an annular internal locking groove to a cylindrically shaped pin end member receivable in said socket end member, said device including:

a cylindrically shaped pin end member having an annular recess, a first locking member rotatably mounted in said recess, a second locking member mounted on said first locking member for relative longitudinal movement and rotation between a locking and an unlocking position, means for limiting the rotational movement of said second locking member to movement between first and second angular positions relative to said cylindrically shaped pin end member, means for coupling said second locking member to said first locking member and for moving said second locking member longitudinally relative to said first locking member during rotation of said second locking member between said first and second angular positions, at least one arcuate locking element on said second locking member for engaging said internal locking groove and for moving radially and progressively outward from a nonengagement retracted position into a fully engaged extended position in said locking groove during rotational movement of said locking ring relative to said pin end member, and cam means on said pin end member for progressively moving said locking element radially into said locking groove.

12. The device as set forth in claim 11 wherein said second locking member is comprised of two mirror image parts, and means for attaching said parts to one another.

13. The device as set forth in claim 11 wherein said first locking member is comprised of two mirror image parts, and means for attaching said parts to one another. Wherein said mirror image parts are constructed from cast steel.

14. The device as set forth in claim 12 wherein said mirror image parts are constructed from steel.

15. The device as set forth in claim 14 wherein said second locking member included an annular ring element and an elongated transverse coupling element coupled to said locking element where said coupling element cants said locking element inwardly toward a center axis for said second locking member.

16. The device as set forth in claim 15 wherein said guide slot includes a pressure recess located angularly relative to said locking element so that said guide lug member is adjacent to said pressure recess prior to release of said locking element from said locking groove.

17. The device as set forth in claim 11 wherein O-ring members are disposed and located between said pin end member and socket end member so as to be compressed while said second locking member moves longitudinally relative to said first locking member.

18. The device as set forth in claim 11 wherein said means for moving includes a guide slot and guide lug member.

19. The device as set forth in claim 11 and further including releasable locking means cooperable in one of said angular locations for releasably locking said pin end member and said socket end member in a locked rotative position.

20. The device as set forth in claim 19 when said locking means includes a spring biased detent member and an opening respectively in the pin end member and the socket member.

21. A subcombination for use in an oil well perforating apparatus wherein coupling devices with O-rings couple and seal adJacent ends of tubular housing members to one another by use of a latching mechanism interengaging with an annular groove in a tubular housing member, said subcombination consisting of:

a tubular coupling device sized for passage through a well bore and for coupling tubular perforating means to one another, said coupling device having pin end members for receipt in a tubular perforating means, each of said pin end members having an annular locking ring rotatably mounted on each of said pin end members in an annular recess in each of said pin end members, means for limiting the rotational movement of each of said locking rings between first and second angular positions relative to the central axis of said cylindrically shaped pin end members, means coupling a locking ring to a pin end member for moving a locking ring longitudinally relative to each of said pin end members during rotation of a locking ring member between said first and second angular positions relative to a pin end member, at least one arcuate locking element on a locking ring for engaging an annular groove in a tubular perforating means by moving radially and progressively from a first position to a second position during rotational movement of a locking ring relative to a pin end member, and cam means on each of said pin end members for progressively moving a locking element radially relative to said central axis.

22. The device as set forth in claim 21 wherein said locking ring is comprised of two mirror image parts, and means for attaching said parts to one another.

23. The device as set forth in claim 22 wherein said locking ring parts are constructed from cast steel.

24. A subcombination for use in an oil well perforating apparatus wherein coupling devices with O-rings couple and seal adjacent ends of tubular perforating gun housing members relative to one another by use of a locking element on a latching mechanism in a coupling device where the locking element interengages with an annular groove in a tubular perforating gun housing member for locking a coupling device to a tubular perforating gun housing member and for reducing the shear load on the locking element when a perforating gun in the housing member is detonated, said subcombination consisting of:

a tubular perforating gun housing member sized for passage through a well bore and for carrying perforating means, said housing member having a central bore and having at each end thereof at least two diametrically stepped cylindrical surfaces for receiving and compressing O-ring sealing means on a coupling device;

said housing member, intermediate of said stepped cylindrical surfaces and a terminal end at each end of said tubular housing member having an annular latching groove for receiving a locking element on a latching mechanism in a coupling device; and said annular groove having at least one side surface for locking interengagment and abutment with a side surface on a locking element on a latching mechanism in a coupling device and where said side surfaces in abutment are inclined with respect to a plane normal to the central axis of said housing member at an angle of 15° or more for minimizing the shear loading on a locking element upon detonation of a perforating means in said housing member.

25. The device as set forth in claim 2 wherein the other side surface of said annular groove and the other side surface of a locking element are inclined with respect to a plane normal to the central axis of said end member at an angle of 15° or more for minimizing the shear loading on a locking element upon detonation of a perforating means in said housing member.

* * * * *